United States Patent [19]

Posner

[11] Patent Number: 4,507,166

[45] Date of Patent: Mar. 26, 1985

[54] METHOD OF MANUFACTURING STICK-ON PHOTOGRAPHS

[76] Inventor: Howard L. Posner, 30 Lakewood Dr., Highland Park, Ill. 60035

[21] Appl. No.: 444,808

[22] Filed: Nov. 26, 1982

[51] Int. Cl.[3] ..... B44C 31/00

[52] U.S. Cl. ..... 156/235; 156/237; 156/238; 156/240; 156/248; 156/252; 156/267; 156/268; 156/344; 430/952

[58] Field of Search ..... 156/230, 235, 237, 238, 156/240, 241, 248, 252, 267, 268, 344, 549, 554, 555; 430/394, 501, 952; 354/339, 346

[56] References Cited

U.S. PATENT DOCUMENTS

| | | | |
|---|---|---|---|
| 2,226,987 | 12/1940 | Wiegand | 430/952 |
| 3,458,385 | 7/1969 | Bova et al. | 156/252 |
| 4,234,673 | 11/1980 | Scrutton et al. | 156/235 |
| 4,260,444 | 4/1981 | Fowler | 156/252 |
| 4,359,358 | 11/1982 | Hattemer | 156/248 |
| 4,447,146 | 5/1984 | Kogane et al. | 354/346 |

*Primary Examiner*—Jay H. Woo
*Assistant Examiner*—Timothy W. Heitbrink
*Attorney, Agent, or Firm*—Kinzer, Plyer, Dorn & McEachran

[57] ABSTRACT

A method of manufacturing adhesive backed photographs attached to an easily removable non-sticking backing sheet. The method includes the steps of forming a pattern of sprocket holes at regular spaced intervals along the length of a roll of unexposed photographic paper. Creating a plurality of latent photographic images on the roll of photographic print paper in a predetermined pattern with the pattern of images registered relative to the pattern of sprocket holes. Developing the latent photographic images on the roll of photographic paper to provide a roll of photographs arranged in a predetermined pattern on one side of the roll of paper. Feeding the row of photographs into a cutter mechanism using the sprocket holes in the photographic paper to register the photographs relative to a cutter element of the cutter mechanism which cuts borders around each photograph. Applying the adhesive side of an adhesive coated release sheet to the back of the roll of photographs after the roll of photographs has been registered relative to the cutter element, but before cutting of the borders by the cutter element. Cutting a border around each photograph with the cuts extending through the photograph paper and adhesive but not through the release paper. Removing the border around each photograph from the roll of photographs. Cutting the roll of photographs into sheets or strips of photographs.

4 Claims, 6 Drawing Figures

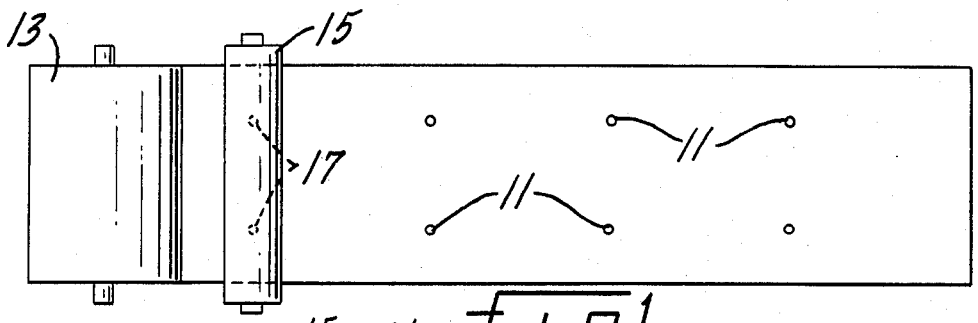
Fig. 1.
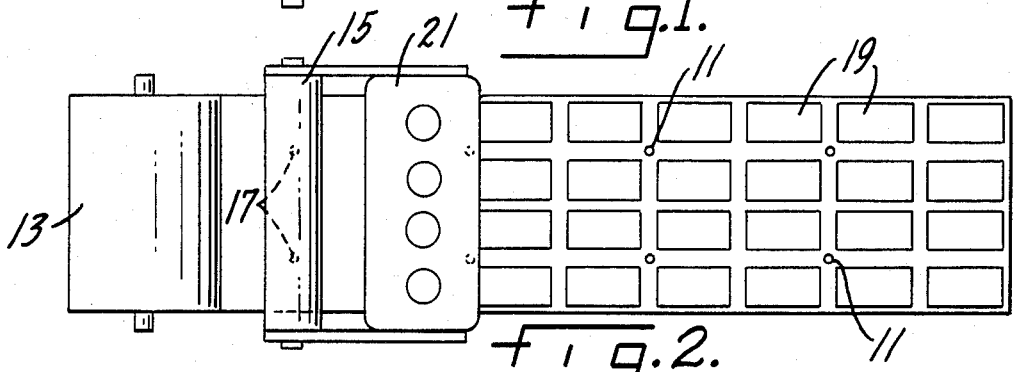
Fig. 2.
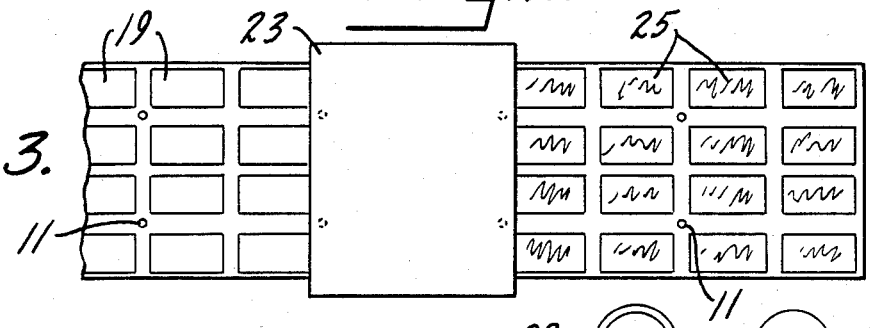
Fig. 3.
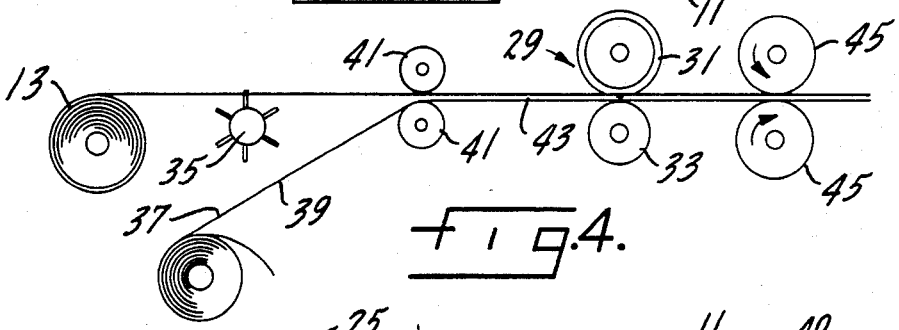
Fig. 4.
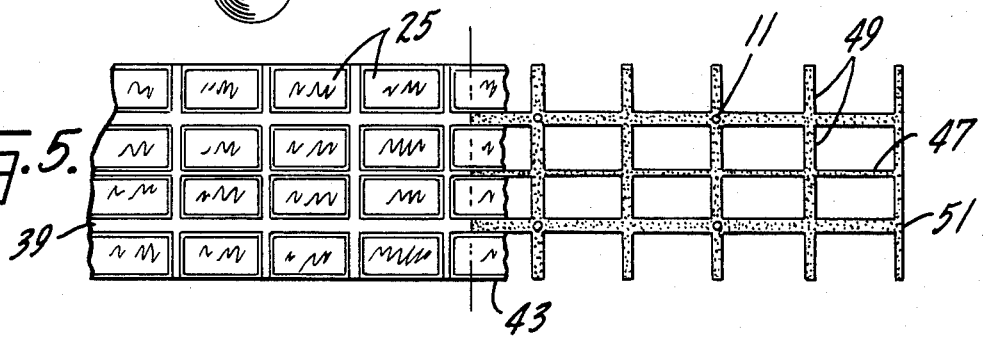
Fig. 5.
Fig. 6.
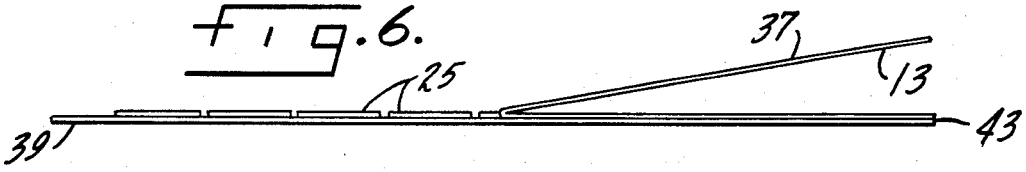

METHOD OF MANUFACTURING STICK-ON PHOTOGRAPHS

BACKGROUND AND SUMMARY OF THE INVENTION

This invention is concerned with a method of making a self-adhering photograph with an adhesive on its reverse side having an easily removable non-sticking backing sheet on the adhesive.

It is particularly concerned with a method of manufacturing sheets or strips of photographs in which each photograph can be removed from the sheet or strip and has its own self-adhering adhesive on the back of the photograph.

An object of this invention is a method of manufacturing sheets of photographs in which each photograph can be removed from its sheet and has its own adhesive backing so it can be attached to another object.

Another object of this invention is a simplified method of aligning photographic images on a roll of photographic print paper so that the photographs are properly registered for subsequent die cutting operations.

Another object of this invention is a method of applying latent photographic images in registry with sprocket holes on a roll of photographic print paper.

Another object of this invention is a method of registering a laminate of photographic paper, adhesive and release paper with a border cutting mechanism using sprocket holes cut only in the photographic print paper.

Other objects may be found in the following specification, claims and drawings.

BRIEF DESCRIPTION OF THE DRAWINGS

The invention is illustrated more or less diagrammatically in the following drawings wherein:

FIG. 1 is a schematic view of an apparatus for punching sprocket holes in a roll of photographic print paper at spaced intervals along the length thereof;

FIG. 2 is a schematic representation of an apparatus for creating a plurality of latent photographic images on the roll of photographic print paper in a predetermined pattern which pattern is registered relative to the sprocket holes;

FIG. 3 is a schematic representation of an apparatus for developing the latent photographic images on the roll of photographic print paper;

FIG. 4 is a schematic representation of a cutter and an apparatus for feeding the roll of photographs into the cutter using the sprocket holes in the photographic paper to register the photographs relative to a cutter element of the cutter mechanism while applying the adhesive side of an adhesive coated release sheet to the back of the roll of photographs;

FIG. 5 is a schematic view showing a border of photographic print film being removed from around the photographs now attached to the adhesive and release sheet; and FIG. 6 is a side elevational view showing the border removing step of FIG. 5.

DESCRIPTION OF THE PREFERRED EMBODIMENT

The first step of my method is to form a pattern of sprocket holes 11 at regularly spaced intervals along the length of a roll 13 of unexposed photographic print paper. The photographic print paper can either be of the type used for color prints or the type used for black and white photographs. The width can be any conventional width in which rolls of such paper can be obtained on the market. For clarity of illustration, the sprocket holes in the drawings are shown as circular holes. Actually, they can be almost any conventional shape. In the preferred method of my invention, the sprocket holes 11 are somewhat crescent shaped. The sprocket holes are formed in the photographic paper by a roll 15 having appropriately shaped punches 17. Such a roll conventionally operates in conjunction with a pressure roll positioned under the paper. The pressure roll is not shown for simplicity of illustration. The sprocket holes may be formed in the paper in a separate operation as shown in FIG. 1 of the drawings or this operation may be combined with the operations shown in FIG. 2.

The next step in my process is to create a plurality of latent photographic images 19 on the roll 13 of photographic print paper in a predetermined pattern with the pattern of images being registered relative to the pattern of sprocket holes 11 as shown in FIG. 2 of the drawings. A conventional machine for printing a number of latent images from a single negative on a roll of photographic paper is a package printer 21. Such machines are available from Nord Photoengineering Company of Minneapolis, Minn. For improved efficiency, the sprocket punching roll 15 can be attached to the package printer 21 at the entrance thereof as shown in FIG. 2.

After the latent photographic images have been created on the roll of photographic paper 13, the paper is developed in a conventional roll type developing machine 23 shown in FIG. 3 thereby creating photographs 25 in a predetermined pattern on one side of the roll of paper. It will be noted that the pattern of photographs is registered relative to the pattern of sprocket holes 11 so that when the photographs are ultimately developed, the sprocket holes are located on the roll between the rows and columns of photographs. It should also be appreciated that the sprocket holes could be in other locations, for example, along opposite edges of the roll 13 of photographic paper.

The developed roll of photographic print paper 13 with its developed photographs 25 and sprocket holes 11 is now fed into a cutter mechanism as shown in FIG. 4 using the sprocket holes 11 to register the photographs relative to a cutter element 29 in the cutter mechanism. As is conventional, the cutting element 29 includes a roll cutter 31 and a back-up roll 33. The cutter element 29 is what is conventionally called a kiss cutter which cuts the roll of paper both longitudinally and transversely.

After the roll 13 of developed photographic paper is aligned with the cutter element 29 by engagement of its sprocket holes 13 with a sprocket feeder 35, the adhesive side 37 of an adhesive coated release sheet 39 is applied to the back of the roll of photographic paper by bringing the adhesive coated release paper and the roll of photographic film into contact between pressure rollers 41 to form a laminate 43. The laminate is then run through the cutter element 29 with the cutter 31 forming longitudinal and transverse cuts through the photographic paper 13 and the adhesive 37 but not through the release sheet 39. The laminate 43 is pulled through the cutter element 29 as shown in FIG. 4 by pressure drive rollers 45.

As shown in FIG. 5, the cutter element 29 provides longitudinal and transverse cuts 47 and 49 respectively around each photograph 25 to form a border 51 around the photographs which border includes the sprocket openings 11. In the next step of my process, the portion of the sheet of photographic print paper containing the border 51 which includes the underlying adhesive 37 is stripped from the laminate 43 leaving a pattern of photographs 25 mounted on the backing release sheet 39. Each photograph 25 shown in FIG. 5 is surrounded by a thin border of the photographic print paper. This border could be eliminated, if desired, by relocating the longitudinal and transverse cuts 47 and 49.

The roll of backing release sheet 39 may now be cut into sheets or strips of photographs 25. Each photograph 25 with its own adhesive 37 may now be removed from the sheets or strips of release paper 39 and may be fastened to letters, objects, walls, etc., thereby functioning as self-adhering photographs.

Whereas a preferred method of practicing my invention has been shown and described, it should be understood and appreciated that modifications and improvements may be made to my process without departing from the spirit of my invention. Therefore, the scope of my invention should be determined by an understanding interpretation of the claims appended hereto.

I claim:

1. A method of manufacturing adhesive backed photographs attached to an easily removable non-sticking backing sheet, including the steps of:

forming a pattern of sprocket holes at regular spaced intervals along the length of a roll of unexposed photographic print paper, creating a plurality of latent photographic images on the roll of photographic print paper in a predetermined pattern with the pattern of images registered relative to the pattern of sprocket holes, developing the latent photographic images on the roll of photographic paper to provide a roll of photographs arranged in a predetermined pattern on one side of the roll of paper, feeding the roll of photographs into a cutter mechanism using the sprocket holes in the photographic paper to register the photographs relative to a cutter element of the cutter mechanism which cuts borders around each photograph, applying the adhesive side of ah adhesive coated release sheet to the back of the roll of photographs after the roll of photographs has been registered relative to the cutter element, but before cutting of the borders by the cutter element, cutting a border around each photograph with the cuts extending through the photographic paper and adhesive but not through the release paper, and removing the border around each photograph from the roll of photographs.

2. The method of claim 1 in which the predetermined pattern of photographic images includes rows and columns of photographic images and the sprocket holes are formed between the rows and columns of photographic images.

3. The method of claim 1 in which the roll of photographs is cut transversely between rows of photographs.

4. The method of claim 1 in which the pattern of sprocket holes formed along the length of the roll of exposed photographic print paper is formed in the areas that are later removed as borders around the photographs.

* * * * *